US005492639A

United States Patent [19]

Schneider et al.

[11] Patent Number: 5,492,639

[45] Date of Patent: Feb. 20, 1996

[54] MANDREL LUBRICANT FOR THE PRODUCTION OF SEAMLESS TUBES

[75] Inventors: Christian Schneider, Luzern; Jacques Périard, Sins, both of Switzerland

[73] Assignee: Lonza Ltd., Gampel/Valais, Switzerland

[21] Appl. No.: 79,064

[22] Filed: Jul. 22, 1994

Related U.S. Application Data

[63] Continuation of Ser. No. 12,954, Feb. 3, 1993, abandoned.

[30] Foreign Application Priority Data

Feb. 6, 1992 [CH] Switzerland ..... 345/92

[51] Int. Cl.[6] ..... C10M 125/00; C10M 173/02

[52] U.S. Cl. ..... 252/30; 252/29; 252/49.3; 72/42

[58] Field of Search ..... 252/30, 29

[56] References Cited

U.S. PATENT DOCUMENTS

| | | | |
|---|---|---|---|
| 3,801,504 | 4/1974 | Stone | 252/30 |
| 3,843,529 | 10/1974 | Bertrand | 252/30 |
| 4,052,323 | 10/1977 | Feneberger et al. | 252/23 |
| 4,107,178 | 8/1978 | Jain et al. | 252/30 |
| 4,808,324 | 2/1989 | Périard et al. | 252/30 |

*Primary Examiner*—Ellen M. McAvoy
*Attorney, Agent, or Firm*—Fisher, Christen & Sabol

[57] ABSTRACT

A mandrel lubricant for use in the production of seamless tubes. The mandrel lubricant composed of graphite, clay minerals from the smectite class, a polysaccharide and optionally a surfactant. The coating of the mandrels that have passed through a cooling bath takes place in the form of an aqueous dispersion.

1 Claim, No Drawings

MANDREL LUBRICANT FOR THE PRODUCTION OF SEAMLESS TUBES

This application is a Continuation of prior U.S. application Ser. No. 08/012,954 filing date Feb. 3, 1993, now abandoned.

BACKGROUND OF THE INVENTION

1. Field of the Invention

The invention relates to a mandrel lubricant for the production of seamless tubes, especially for the coating of mandrels that have passed through a cooling bath after the rolling operation and are being prepared for the next rolling operation.

2. Background Information

In modern tube rolling mills, e.g., in continuous tube trains (MPM-trains), the shaping of the seamless tubes takes place in the main process step by rolling of a prefabricated ingot heated to 1200° to 1300° C. over a mandrel which is mounted on a mandrel rod. After the rolling operation, the mandrel or the mandrel rod is removed from the tube round and fed to a cooling bath where the mandrel or the mandrel rod is cooled down from about 150° to 350° C. to a temperature of about 60° to 100° C., and in this way, is prepared for the next rolling operation. A lubrication composition is also included in this preparation of the mandrel or mandrel rod after the cooling bath. This lubrication composition is essential to assure an optimal "sliding" of the ingot on the mandrel rod during the rolling operation and is one of the factors decisive for the later quality of the tube, i.e., for the condition of the inner surface of the tube.

Generally, this lubrication composition was made with graphite-containing oils. By burnoff of oil on contact of the mandrel with the hot ingot, a very strong smoke development occurred that, because of the toxic components of the smoke, led to an unacceptable pollution of the surrounding area and environment. On the other hand, this uncontrolled burnoff caused by the ingot during the rolling operation led to damage to the lubricant coating on the mandrel and possibly to damage to the inner surfaces of the tubes.

Then, in German Patent No. 2450716, especially in Example 5, it was proposed to use a high temperature lubricant essentially consisting of graphite and an alkylene polymer. This lubricant was applied immediately after the rolling operation of the still uncooled mandrel, whereupon a dry and partially water-resistant lubricant film formed. The mandrel so treated was then able to be fed to the cooling bath and later, without relubrication, again to the rolling process. But it has turned out that by the mechanical stress on the mandrel in transport, by the cooling bath and by the action of the water, the lubricating film is often damaged which in turn has a negative effect on the quality of the tube.

Since in modern rolling trains the lubrication composition of the mandrels takes place after the cooling bath, it was then attempted, corresponding to the lubrication composition with graphite-containing oils, to apply the lubricant formulation of German Patent No. 2450716 to mandrels that have already passed the cooling bath. As required by the process, the time between application of the lubricant to the 60° to 100° C. mandrel up to the rolling operation is limited to a maximum of 5 seconds.

As the present inventors' comparison tests show (see examples), even the formation of a dry lubricant film with the lubricants according to German Patent No. 2450716 takes at least 15 seconds. As a result, the same effect is observed as in the treatment of the mandrel with graphite-containing oils when the treated mandrel comes in contact with the hot ingot. Moreover, the polymeric components are subjected to pyrolysis which leads to damage to the lubricant film during the rolling operation and, thus, finally adversely affects the quality of the tubes.

BROAD DESCRIPTION OF THE INVENTION

The main object of the invention is to provide a lubricant that does not have the above-mentioned drawbacks and which is especially suitable to provide mandrels that have passed through the cooling bath with a quick-drying, high-grade lubricant film. The object of the invention is achieved with the invention lubricant composed of:

(a) 60 to 95 percent by weight of a natural or synthetic graphite;

(b) 5 to 40 percent by weight of one or more clay minerals from the smectite class;

(c) 0.2 to 2 percent by weight of a polysaccharide or one of its derivatives; and (d) 0 to 5 percent by weight of a non-ionic surfactant.

Other objects and advantages of the invention are set out herein or are obvious herefrom to one skilled in the art.

The objects and advantages of the invention are achieved by the lubricants and processes of the invention.

Preferably the mandrel lubricant consists of:

(a) 75 to 90 percent by weight of a natural or synthetic graphite;

(b) 5 to 25 percent by weight of one or more (i.e., at least one) clay minerals from the smectite class;

(c) 0.5 to 1 percent by weight of a polysaccharide or its derivatives; and (d) 0 to 2 percent by weight of a non-ionic surfactant.

The invention includes the coated mandrels for the production of seamless tubes. The mandrel having passed through the cooling bath after the rolling operation takes place and before the next rolling operation. The mandrel has a coating of a mandrel lubricant. The mandrel lubricant consists of:

(a) 60 to 95 percent by weight of a member selected from the group consisting of natural graphite and synthetic graphite, the natural graphite having a crystal size $L_c$ greater than 100 nm and an ash content of a maximum of 5 percent, and the synthetic graphite having a crystal size $L_c$ greater than 100 nm and a purity of 99.9 percent or higher;

(b) 5 to 40 percent by weight of montmorillonite with a swelling capability in water of 3 to 50;

(c) 0.2 to 2 percent by weight of at least one member selected from the group consisting of polysaccharide and one of its derivatives;

(d) 0 to 5 percent by weight of non-ionic surfactant; and (e) optionally, a biocide in an amount which is effective to protect said polysaccharide or one of its derivatives from bacterial attack. The invention also includes the seamless tubes prepared using the counted mandrels in the hot rolling operation. The invention also includes the hot rolling operation for making seamless tubes using the coated mandrels.

DETAILED DESCRIPTION OF THE INVENTION

Suitable natural graphites are those with a high crystallinity, i.e., with a crystalite size $L_c$ greater than 100 nm and an ash content of a maximum of 5 percent. Suitable synthetic graphites also have a high crystallinity $L_c$ greater than 100 nm and a purity of 99.9 percent and more. Preferably a synthetic graphite is used. The particle size ($d_{50}$) of the graphites used can vary in a range of 5 μm to 30 μm.

Clay minerals from the smectite class are used as an additional necessary component of the lubricant. The smectites essentially comprise sheet silicates and are distinguished because of their structure by a high cation exchange capability and by their swelling capability in water (*Ullmanns Encyklopädie der Techn. Chemie* [Ullmann's Encyclopedia of Industrial Chemistry], 4th edition, VCH Weinheim, Vol. 23, pp. 311ff.). From the smectite group, montmorillonites are preferably used that have a swelling capability (1 g of montmorillonite in distilled water) of 3 to 50. Due to the above-mentioned cation exchange capability, the montmorillonites can be "modified" with inorganic or organic cations.

The above-mentioned clay minerals as an inorganic lubricant component are distinguished by excellent binding properties and, moreover, have the advantage that, in contrast with polymers or oils, they are not subjected to pyrolysis. Moreover, in the lubricant, the above-mentioned clay minerals are substantially responsible for a surprisingly quick drying time, in the range of 1 up to 5 seconds, of the lubricant film on the mandrel. In other words, in view of the mentioned short time between application of the lubricant and the rolling operation with the lubricant according to the invention, that is, a maximum of 5 seconds, a uniform and dry lubricant film on the mandrel can be produced even before the mandrel is inserted in the ingot.

As another necessary component of the lubricant according to the invention, a polysaccharide or a derivative of it is used as thickening agent. This lubricant component has the object of assuring a constant viscosity of the lubricant dispersion over a wide temperature range as well as to prevent the sedimentation of the solid particles in the dispersion. Biopolysaccharides, such as, xanthan gum, rhamsan gum, or an alkyl cellulose derivative, such as, hydroxypropylmethyl cellulose, from the series of polysaccharides or their derivatives are suitably used.

To protect the thickening agent from a bacterial attack, suitably a commercially available biocide is added.

To obtain good film properties of the lubricant and to influence the viscosity of the lubricant, additionally a non-ionic surfactant is suitably used. (When a non-ionic surfactant is used, the amount is in the range of about 0.001 to 5 percent by weight.)

Suitably used as non-ionic surfactants are those as described in *Ullmanns Encycl. der Techn. Chemie,* VCH Weinheim, 4th Ed., Vol. 22, page 489. Especially suitable representatives of this class are the oligomeric oxyethylates or the oxyethylates modified with oxypropyl groups (*Ullmanns Encycl. der Techn. Chemie,* loc. cit., pp. 489ff.).

The lubricant according to the invention is suitably used in the form of an aqueous dispersion with a solid content of usually 20 to 40 percent by weight. But these range limits can be varied up or down based on the actual use situation. The production of the dispersion can take place in commercially available dispersion devices that make high shearing forces possible.

The coating of the lubricant on the mandrel can take place e.g., by a spray ring placed between the cooling bath and the rolling mill, through whose center the mandrel rod is conveyed and is evenly provided with lubricant.

As a rule, the coating amount is controlled so that about 40 g/m$^2$ of lubricant (without water) is on the mandrel.

EXAMPLE 1

| | |
|---|---|
| Formulation 1 (F1) | |
| synthetic graphite type T75 LONZA | 86.8% by weight |
| modified montmorillonite with a swelling capability of 10–50 | 11.2% by weight |
| methylhydroxypropyl cellulose | 1.9% by weight |
| | 100.0% by weight |
| dispersion of $H_2O$ with solid content | 24.6% by weight |
| Formulation 2 (F2) | |
| synthetic graphite type T75 LONZA | 78.2% by weight |
| montmorillonite with a swelling capability of 9–14 | 20.0% by weight |
| surfactant synperonic PE/F68 of the ICI Co. (oxyethylate modified oxypropyl groups) | 1.2% by weight |
| xanthan gum | 0.5% by weight |
| biocide | 0.1% by weight |
| | 100.0% by weight |
| dispersion / $H_2O$ with solid content | 30.0% by weight |
| Formulation 3 (F3) | |
| natural graphite with an ash content of 4.5% | 77.0% by weight |
| montmorillonite with a swelling capability of 10–30 | 3.0% by weight |
| montmorillonite with a swelling capability of 3–5 | 18.0% by weight |
| surfactant synperonic PE/F68 of the ICI Co. (oxyethylate modified oxypropyl groups) | 1.2% by weight |
| rhamsan gum | 0.7% by weight |
| biocide | 0.1% by weight |
| | 100.0% by weight |
| dispersion in $H_2O$ with solid content of 30% by weight | |
| Formulation 4 (F4) | |
| synthetic graphite type LONZA T75 | 90.9% by weight |
| montmorillonite type with a swelling capability of 10–50 | 7.0% by weight |
| surfactant synperonic PE/F68 of the ICI Co. (oxyethylate modified oxypropyl groups) | 1.2% by weight |
| xanthan gum | 0.7% by weight |
| biocide | 0.2% by weight |
| | 100.0% by weight |
| dispersion in $H_2O$ with solid content of 30% by weight | |

Comparison formulation 1, VF1 (according to German Patent No. 2450716)

20% of graphite 9.5% of vinylacetate copolymer

1% of polysaccharide 69.5% of water

Comparison formulation 2, VF2 (graphite-containing mineral oil)

35% of graphite

65% of mineral oil

Drying Test

The described dispersions were sprayed on a test mandrel at a temperature of 100° C. The drying time was measured.

TABLE

| Formulation | Amount [g/m$^2$] | Drying Time [s] |
|---|---|---|
| F1 | 36.8 (150° C.) | 5.0 |
| F2 | 26.0 | 2.0 |
| F3 | 40.0 | 2.0 |
| F4 | 25.0 | 0.5–1 |
| VF1 | 40 | 15 |
| VF2 | immersion process | no drying |

What is claimed is:

1. A process comprising coating a mandrel in the production process of seamless tubes, which has passed through the cooling bath after a rolling operation takes place and is being prepared for the next rolling operation, with a mandrel lubricant, the mandrel being at a temperature of about 60° to 100° C., the mandrel lubricant comprising:

(a) 60 to 95 percent by weight of a member selected from the group consisting of natural graphite and synthetic graphite, the natural graphite having a crystal size $L_c$ greater than 100 nm and an ash content of a maximum of 5 percent, and the synthetic graphite having a crystal size of $L_c$ greater than 100 nm and a purity of 99.9 percent or higher;

(b) 5 to 40 percent by weight of montmorillonite having a swelling capability in water of 3 to 50;

(c) 0.2 to 2 percent by weight of at least one member selected from the group consisting of polysaccharide and one of its derivatives;

(d) 0.001 to 5 percent by weight of a non-ionic surfactant; and (e) sufficient water to form said aqueous dispersion, the total weight of (a) to (d) being 100 percent by weight.

* * * * *

UNITED STATES PATENT AND TRADEMARK OFFICE
CERTIFICATE OF CORRECTION

PATENT NO. : 5,492,639

DATED : Feb. 20, 1996

INVENTOR(S) : Schneider et al.

It is certified that error appears in the above-identified patent and that said Letters Patent is hereby corrected as shown below:

Title page, under [21] Appl. No.: delete "79,064" and insert --279,064--.

Signed and Sealed this

Twenty-eighth Day of May, 1996

*Attest:*

Bruce Lehman

BRUCE LEHMAN

*Attesting Officer*

*Commissioner of Patents and Trademarks*